US008344896B2

(12) United States Patent
Ozanne

(10) Patent No.: US 8,344,896 B2
(45) Date of Patent: Jan. 1, 2013

(54) PROCESS FOR DETECTING SCALE FORMATION IN A BEVERAGE PREPARATION MACHINE

(75) Inventor: Matthieu Ozanne, Chessel (CH)

(73) Assignee: Nestec S.A., Vevey (CH)

( * ) Notice: Subject to any disclaimer, the term of this patent is extended or adjusted under 35 U.S.C. 154(b) by 409 days.

(21) Appl. No.: 12/792,039

(22) Filed: Jun. 2, 2010

(65) Prior Publication Data

US 2011/0132925 A1 Jun. 9, 2011

(30) Foreign Application Priority Data

Jun. 3, 2009 (EP) ..... 09161808

(51) Int. Cl.

| | |
|---|---|
| ***G08B 21/00*** | (2006.01) |
| ***G01N 15/08*** | (2006.01) |
| ***G01F 1/11*** | (2006.01) |
| ***G05D 7/00*** | (2006.01) |
| ***F25B 27/00*** | (2006.01) |
| ***E21B 47/10*** | (2012.01) |

(52) U.S. Cl. ..... 340/606; 702/12; 702/45; 702/50; 702/55; 700/282; 700/285; 62/238.7; 73/152.18

(58) Field of Classification Search ..... None
See application file for complete search history.

(56) References Cited

U.S. PATENT DOCUMENTS

| | | | | |
|---|---|---|---|---|
| 4,308,475 | A | 12/1981 | Haeck | |
| 5,103,649 | A | 4/1992 | Kieffer | |
| 6,196,422 | B1 | 3/2001 | Tuyls et al. | |
| 7,673,557 | B2 * | 3/2010 | Bienvenu et al. | 99/291 |
| 7,819,020 | B2 * | 10/2010 | Jacobi et al. | 73/861.12 |
| RE43,334 | E * | 5/2012 | Simmons | 239/63 |
| 2006/0043101 | A1 | 3/2006 | Bhimani et al. | |
| 2008/0008461 | A1 | 1/2008 | Hu et al. | |
| 2012/0164285 | A1 * | 6/2012 | Doglioni Major | 426/231 |

FOREIGN PATENT DOCUMENTS

| | | |
|---|---|---|
| EP | 0266223 | 5/1988 |
| EP | 0288216 | 10/1988 |
| JP | 08161630 | 6/1995 |
| JP | 2000276652 | 10/2000 |

* cited by examiner

*Primary Examiner* — Jennifer Mehmood
*Assistant Examiner* — Fekadeselassie Girma
(74) *Attorney, Agent, or Firm* — K&L Gates LLP

(57) ABSTRACT

The invention concerns a process for detecting scale deposit in the liquid supply means of a water pump driven machine comprising at least a water tank, a pump and a heating means, where water is pumped from the water tank and fed to the heating means, and where the pump is energized by a controller by providing the pump with an energizing signal to provide an intended water flow rate F, wherein the actual water flow rate f is measured and the discrepancy Δ between the actual water flow rate f and the intended water flow rate F is directly and/or indirectly compared to an operating instruction related to scale deposit.

11 Claims, 4 Drawing Sheets

PROCESS FOR DETECTING SCALE FORMATION IN A BEVERAGE PREPARATION MACHINE

BACKGROUND

The present invention relates to a process for detecting scale deposit in the liquid supply means of a machine producing hot water, in particular a beverage preparation machine, and a machine for implementing this process.

SUMMARY

It is a well-known problem with any beverage producing device having e.g. a boiler for heating water in order to produce a beverage on the basis of the heated water that the boiler as well as other elements and water heating elements is prone to scale deposition when using the device over a longer period. This scale origins from scale-forming ions contained in the water supply wherein the scale-content is especially high in so-called hard water. To descale (note that the term "descaling" is used in an equivalent matter in the following with the term "decalcification") it is known to periodically have pass through the scale deposition prone tubing a decalcifying agent (e.g. vinegar) which dissolves any deposited scale when passing through the machine. It is important to survey the progressive building of scale in the heated water supply means so as to be able to descale at an early stage otherwise the heated water supply means can be irreparably broken.

The present invention aims at solving the problem of detecting as soon as possible the deposit of scale in the liquid supply means of a machine producing hot water.

According to a first aspect, the invention concerns a process for detecting scale deposit in the water supply means of a pump driven machine, and in particular in a beverage preparation machine, comprising at least a water tank, a pump and a heating means, where water is pumped from the water tank and fed to the heating means, and where the pump is energized by a controller by providing the pump with an energizing signal to provide an intended flow rate F, wherein the actual water flow rate f is measured and the discrepancy Δ between the actual water flow rate f and the intended water flow rate F is directly and/or indirectly compared to an operating instruction related to scale deposit.

The process of the present invention is implemented in machines for producing pressurized hot water in which the pressurized hot water is provided by liquid supply means comprising at least a water tank, a pump and a heating means successively integrated in the liquid supply means. Usually cold water is stored in the water tank and pumped by the pump to provide pressurized cold water. Said pressurized cold water is then delivered to the heating means to produce pressurized hot water. The pump is energized by a controller which provides the pump with an energizing signal setting the amount of energy to be fed to the pump and at least partially correlated to the intended water flow rate F to be delivered. According to the method of the present invention, the actual water flow rate f is measured and is compared to the intended water flow rate F that is expected. In the normal conditions of use of the pump there is almost no difference between the values of the intended and the actual water flow rate (f and F). But if the scale is obstructing a part of the supply means then the pump is no more able to deliver the intended water flow rate F according to the normal conditions of use—in particular with the amount of energy set for the normal conditions. Then the difference between these values of the intended and the actual water flow rate (f and F) increases. In the present invention the discrepancy between the actual water flow rate f and the intended water flow rate F is compared to an operating instruction initially set in the machine processor. If the discrepancy Δ reaches the operating instruction, scale deposit is detected. The value of the operating instruction is generally fixed by experimental testing on the machine.

According to a first embodiment, the water pump driven machine can comprise a pump that is energized by a fixed energy linked to the indented water flow rate F. The discrepancy Δ between the actual water flow rate f and the intended water flow rate F is directly compared to a water flow operation instruction related to scale deposit. In this embodiment the pump is energized by an energising signal of which value depends from the intended water flow value. This value is fixed and does not vary during the pumping operation. This value can be fixed by the processor of the machine.

According to a second embodiment, the water pump driven machine can comprise a controller that sets the amount of energy of the pump at least partially in response to an actual water flow rate indication signal. If the value of the actual water flow rate f derives from the value of the intended water flow rate F, the controller can modify the amount of energy of the pump so that the intended flow rate F is finally reached. This process can be implemented by a feedback loop between the controller and a flow meter measuring the actual water flow rate f. In this embodiment, if scale obstructs a part of the supply means, then the actual water flow rate f and the implemented energizing signal respectively differ from the intended water flow rate F and the energizing signal initially set for reaching the intended water flow rate F. Then in this embodiment the discrepancy Δ between the actual water flow rate f and the intended flow rate F and/or the energizing signal can be compared to an operating instruction related to scale deposit.

In the case where the energizing signal is compared to an operating instruction related to scale deposit, the discrepancy Δ between the actual water flow rate f and the intended flow rate F is indirectly compared to an operating instruction related to scale deposit since this discrepancy is used to modulate the energizing signal.

In practice the operating instruction is a specific value of the discrepancy Δ between the actual water flow rate and the intended flow rate F and/or a specific value of the energizing signal correlated with the presence of scale in the liquid supply means. As mentioned above the value of the operating instruction is generally fixed by experimental testing on the machine.

The pump is preferably a DC (direct current) motor driven pump or a solenoid pump comprising a spring-loaded linear pumping member axially displaceable between a spring-loaded position and a spring-released end position controlled by the controller responsive to a current waveform and being arranged to generate an energizing signal for controlling the pumping member from said current waveform by excluding a part of the current waveform from the energizing signal such that the pumping member is energized into an intermediate position between the spring-released end position and the spring-loaded position. But any other kind of pump can be used in the process of the present invention.

In this last type of pump, the energizing signal is preferably a phase-angled sinusoidal signal, with the amount of energy being defined by the phase-angle (θ), even more preferably the phase-angled sinusoidal signal is a phase-angled part of a rectified half-period of the alternating current.

According to a preferred embodiment of the present invention, the discrepancy Δ between the actual water flow rate f and the intended water flow rate F is directly and/or indirectly compared to the operating instruction related to scale deposit when the pump has reached stable operating conditions. Depending from the type of pump that is used, the comparison can be realised after a certain defined time after the pump is switched on.

According to another preferred embodiment of the present invention, an alert message is provided if the discrepancy Δ between the actual water flow rate F and the intended water flow rate f is superior to the water flow operating instruction related to scale deposit and/or the energizing signal is superior to the pump power operating instruction related to scale deposit. The machine can be programmed so that the scale deposit alert message is provided only after the discrepancy Δ between the actual water flow rate and the intended water flow rate has been superior to the water flow operating instruction related to scale deposit and/or the energizing signal has been superior to the pump power operating instruction related to scale deposit for a certain time or during the preparation of a certain number of beverages, in the case of beverage machine.

In relation with the above described second embodiment the pump can be proportioned so as to provide the maximal water flow of the beverage preparation machine with less than a fixed percentage of its nominal power, for example 90%. In this configuration, the pump power operating instruction related to scale deposit can equal the fixed percentage of the pump nominal power. Consequently, if the controller provides the pump with a power greater than the fixed percentage of its nominal power, for example more than 90%, then an alarm signal can be emitted.

The invention also concerns a beverage dispensing apparatus, comprising at least a water tank, a pump, a heating means, a flow meter for measuring an actual flow rate f, a controller setting an amount of energy to provide the pump with and alert means arranged to compare the discrepancy Δ between the actual water flow rate f and an intended water flow rate F and/or the energizing signal to a corresponding operating instruction related to scale deposit.

In an embodiment, the apparatus comprises a signal processor, wherein the controller is implemented in software on the signal processor.

The beverage dispensing apparatus usually comprises a beverage production chamber designed to have the pumped hot water from the liquid supply means interact with a beverage ingredient placed in the chamber in the form of loose material, e.g. coffee granules or tea leaves, or packaged in a pad, capsule or other suitable package.

The present invention presents the advantage of enabling the detection of scale as soon as it begins to deposit in the conduits of the liquid supply means and to alert the operator so that he can descale the machine before an irreparable damage of the machine.

Additional features and advantages are described herein, and will be apparent from the following Detailed Description and the figures.

BRIEF DESCRIPTION OF THE FIGURES

The characteristics and advantages of the invention will be better understood in relation to the figures which follow.

DETAILED DESCRIPTION

Figure 1A:
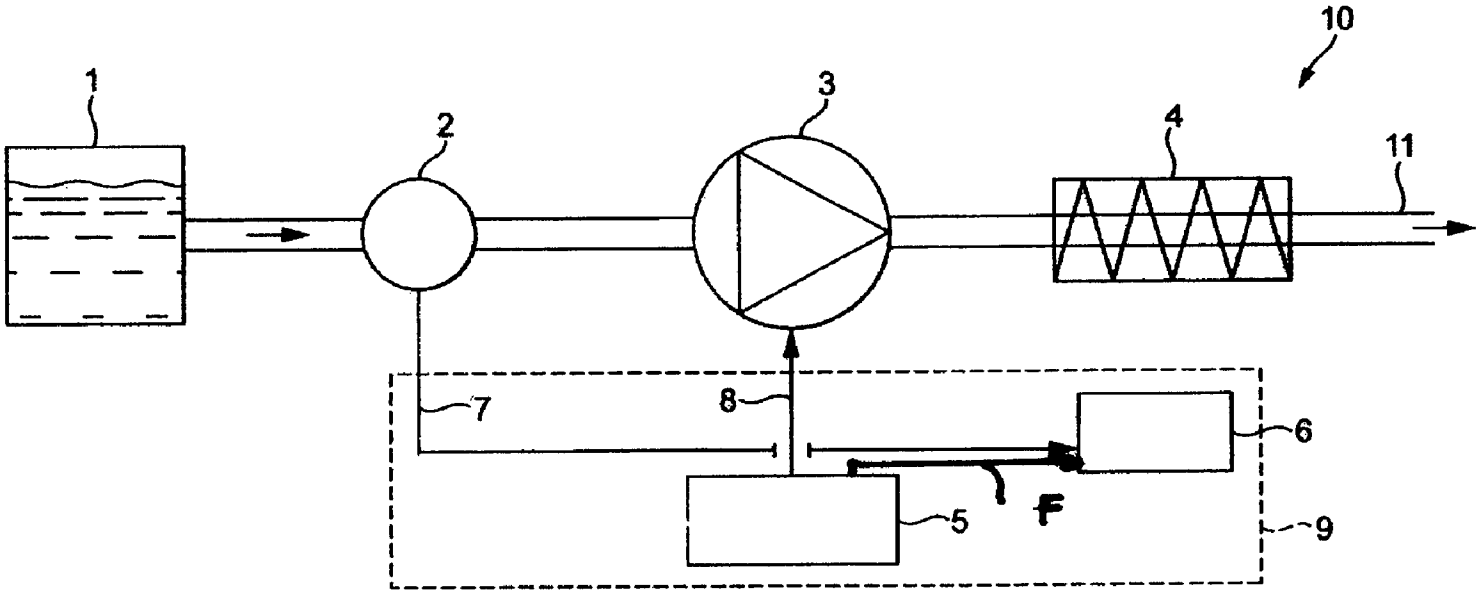
FIG. 1A is a schematic diagram of liquid supply means for implementation of the process according to the first embodiment of the present invention.

FIG. 1A schematically depicts a the liquid supply means 10 of a machine for producing pressurized hot water in accordance with the present invention. The liquid supply means 10 comprises a water tank 1 and a water outlet 11 for dispensing pressurized hot water. A pump 3 is arranged between the tank 1 and the water outlet 11 for pumping water from the tank 1 to the outlet 11. The pump 3 is controlled by a controller 5, which will be described in more detail later.

The conduit between the tank 1 and the water outlet 11 further comprises a flow meter 2, which may be a paddle wheel-based flow meter, and a heating means 4. In addition, the liquid supply means 10 may have any suitable configuration, since the embodiment of the liquid supply means 10 is not critical to the present invention. For instance the conduit between the tank 1 and the water outlet 11 may further comprise a temperature sensor and, if the machine is a beverage preparation machine, a holder for receiving a beverage brewing product, e.g. coffee or tea, which may be placed in the holder in the form of loose material, e.g. coffee granules or tea leaves, or packaged in a pad, capsule or other suitable package. Other embodiments are equally suitable.

The controller 5 is arranged to provide the pump 3 with an energizing signal 8. The energizing signal 8 is defined by the controller 5 to ensure that the water presented at the water outlet 11 has the required properties, in particular flow rate.

Control of the flow rate may also be important to ensure that the heating means 4 is capable of appropriately adjusting the temperature of the water. In case of an excessive flow rate, the heating means 4 may have insufficient capacity to sufficiently adjust this temperature. The flow rate may also play an important role in the brewing or dissolution of the food ingredient products. For instance, if the machine is a beverage preparation machine, the control of the flow rate may be important to ensure that the fluid flow rate is relatively constant, and at a rate that is experienced as pleasant by the user of the beverage dispensing apparatus. Control of the flow rate may also be important to ensure that, in case the beverage dispensing apparatus comprises a beverage brewing product holder, the strength of the beverage presented at the fluid outlet is in accordance with user requirements.

The intended water flow rate may correspond with a user-selected water output requirement, and may be stored in any suitable data storage medium, e.g. a SRAM, a ROM, a look-up table and so on. In the case of a beverage dispensing apparatus, the liquid supply means 10 may comprise a user interface, e.g. one or more buttons, for allowing a user to define such a water output requirement, e.g. the strength or temperature of a beverage to be dispensed. The intended water flow rate may also correspond to a preset flow rate profile stored in the data storage medium of the machine.

The controller 5 sets the energy that must be applied to the pump to get the intended water flow rate F, as set in the data storage medium. The controller 5 may be a discrete component of the liquid supply means 10 realized in hardware. Alternatively, the controller 5 may be a part of a signal processor 9, which may be further arranged to implement other controllers, e.g. a controller for controlling the temperature of heating means 4, and the feedback signal from a temperature sensor. The controller 5 may be implemented in software on such a signal processor 9. The energizing signal 8 of the controller 5 is directly linked to the power used by the pump 3. The power is set by the controller 5 in order to get the intended water flow range F.

The signal processor 9 also comprises a scale detection module 6 to which is provided the feedback signal 7 from the flow meter 2 indicating the actual water flow rate f. The scale detection module 6 compares the actual water flow rate f with the intended water flow rate F. The detection module 6 can calculate the discrepancy Δ between the intended water flow rate F and the actual water flow rate f. If the discrepancy Δ is superior to the water flow operating instruction related to scale deposit, then alert means generate an alarm to inform the user that scale has been deposited in the liquid supply means and that either a scale treatment must be made or a filter cartridge must be changed.

Figure 1B:
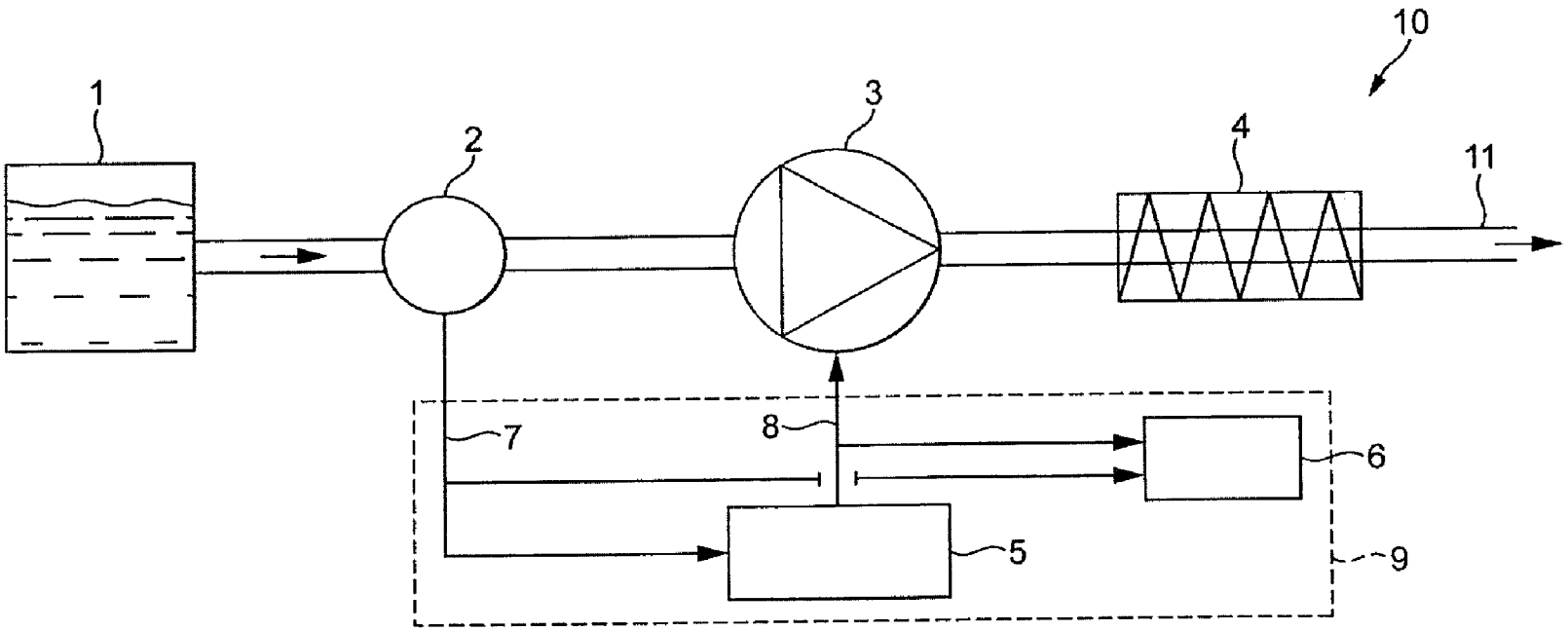
FIG. 1B is a schematic diagram of liquid supply means for implementation of the process according to the second embodiment of the present invention, FIG. 2 schematically depicts an aspect of the pump of the liquid supply means in accordance with the second embodiment of the present invention in greater detail, FIG. 3 schematically depicts an aspect of an alternative pump of the liquid supply means in accordance with the second embodiment of the present invention, FIG. 4 schematically depicts a control signal for a solenoid pump in accordance with the second embodiment of the present invention, and FIG. 5 schematically depicts a control signal for a solenoid pump in accordance with and alternative of the second embodiment of the present invention.

FIG. 1B illustrates the second embodiment of the present invention where the controller 5 may modulate the energy the pump is provided with in order to guarantee the delivery of the intended flow rate. To this end, the controller 5 is responsive to signals indicative of the read-out data from the water flow meter 2. The controller 5 may be arranged to compare such a feedback signal 7 from the water flow meter 2 indicating the actual water flow rate f, with the intended water flow rate F, and be arranged to adjust the energizing signal 8 in response to a discrepancy between the actual water flow rate f and the intended water flaw rate F. The energizing signal 8 of the controller 5 is directly linked to the power used by the pump 3. The power is dynamically adjusted by the controller 5, e.g. in response to the feedback signal 7 from the flow meter 2, indicating a discrepancy between the intended water flow rate f and the actual water flow rate F. This discrepancy may be due to the obstruction of the conduit by scale deposit.

The scale detection module 6 compares the discrepancy Δ between the actual water flow rate f and the intended water flow rate F to a water flow operating instruction related to scale deposit and/or the energizing signal 8 to the pump power operating instruction related to scale deposit. If the discrepancy Δ is superior to the water flow operating instruction related to scale deposit and/or if the energizing signal 8 is superior to the pump power operating instruction related to scale deposit, then an alarm is generated to inform the user that scale is present in the liquid supply means and that either a scale treatment must be made or a filter cartridge must be changed.

Figure 2:
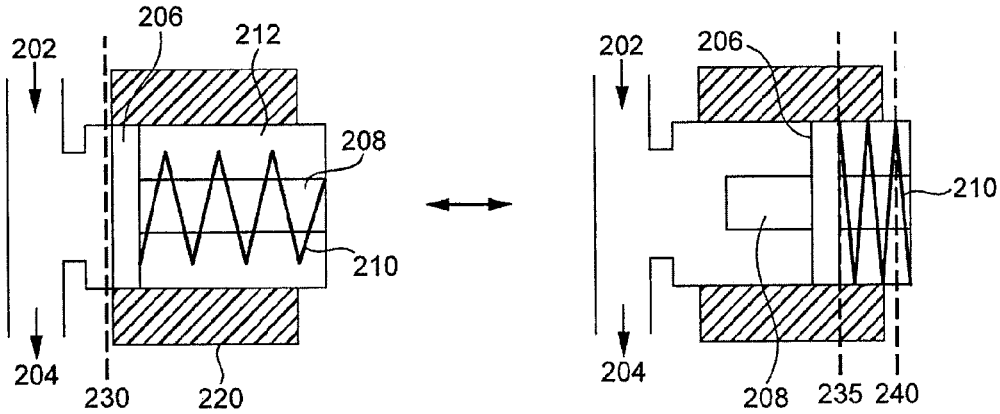

A specific embodiment of the pump that can be used in the second embodiment is explained in more detail in FIG. 2. In FIG. 2, the solenoid pump comprises a water inlet 202 and a water outlet 204, which may comprise valves (not shown). The solenoid pump further comprises an axially displaceable pumping member 206, e.g. a piston or a diaphragm, which is axially displaceable over an axis 208 under control of the solenoid 220. To this end, the pumping member 206 may comprise a magnetic material. A spring 210 is mounted behind the pumping member 206 such that the spring 210 is compressed when the pumping member 206 is moved towards the inlet 202 under control of the solenoid 220.

Figure 3:
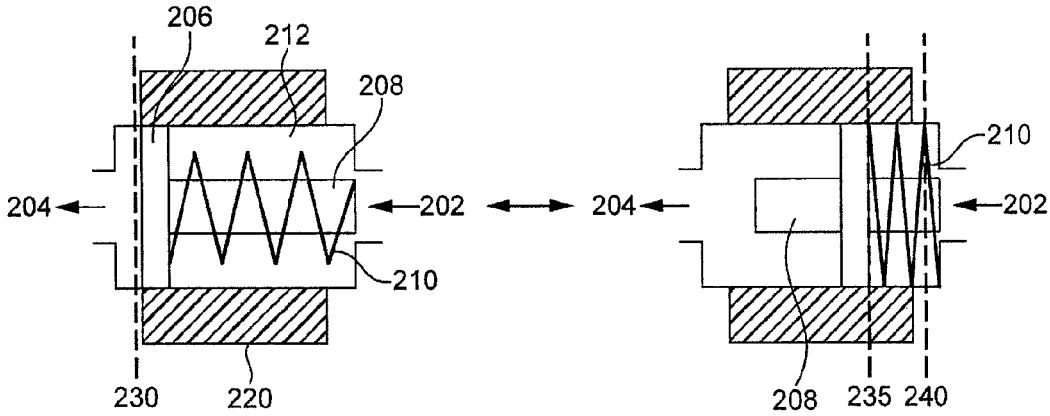

In FIG. 2, the solenoid pump 106 is configured to have a T-junction arrangement between the inlet 202, the outlet 204 and the chamber 212 of the solenoid pump. However, it is emphasized this arrangement is shown by way of non-limiting example only, and that other embodiments of the solenoid pump are equally feasible, such as an alternative arrangement in which the solenoid pump of FIG. 1 is replaced with a solenoid pump as shown in FIG. 3. In the solenoid pump shown in FIG. 3, the chamber 212 is placed between the inlet 202 and the outlet 204. Such a solenoid pump is also well-known; see for instance U.S. Pat. No. 6,942,470.

The pumping member 206 can be axially moved between an end position 230, in which the spring 210 has released its tension, and a spring-loaded position 240 under control of the solenoid 220, in which the spring 210 is fully compressed. The end position 230 may comprise a stop, e.g. a shock absorbing member. The displacement of the pumping member 206 from end position 230 towards the spring loaded position 240 causes a water to be sucked into the chamber 212 of the solenoid pump 106 through inlet 202, whereas the release of the tension in the spring 210 causes the pumping member 206 to be displaced towards the end position 230, thereby pumping the water collected in the chamber 212 through the outlet 204.

As has been explained previously, the release of the tension in the spring 210 during the pumping action of the solenoid pump 106 accelerates the pumping member 206 towards the end position 230, with the impact of the pumping member 210 at the end position 230 creating a substantial amount of noise. To this end, in accordance with the present invention, the controller 108 is arranged to control the solenoid 220 such that the pumping member is not fully retracted into the chamber 212, but displaced from the end position 230 to an intermediate position 235 in between the end position 230 and the spring-loaded position 240. In other words, the amount of energy stored in the form of tension (compression) of the spring 210 is less than the maximum amount of energy that can be stored in the spring 210. Consequently, when the spring 210 is released, the force on the pumping member 206 is reduced compared to the force generated by a fully loaded spring 210, thus reducing the impact of the pumping member 206 on the end position 230 and the noise generated by this impact.

A further advantage of partially retracting the pumping member 206 into the chamber 212 is that the water flow rate generated by the solenoid pump may be adjusted whilst still activating the solenoid pump in each phase cycle of an alternating current powering the liquid supply means 10 of the machine and/or the controller 5. This may be achieved by dynamically adjusting the intermediate position 235, e.g. moving it towards the end position 230 or towards the spring-loaded position 240. This is not possible in solenoid pumps in which the amount of force exerted by the spring 210 on the pumping member 206 cannot be adjusted. In such pumps, the flow rate must be adjusted by altering the number of phase cycles during which the pump is activated, e.g. burst fire mode controlled solenoid pumps. However, as previously explained, such pumps exhibit substantial variations in the water flow rate over a period of time, which can cause problems when monitoring the flow rate with a paddle wheel-based flow meter, because such flow meters cannot respond correctly to the sudden changes in the water flow rate that are typical for burst fire mode controlled solenoid pumps. The activation of the solenoid pump in substantially every phase cycle of the controller 5 ensures that the water flow rate through the conduit of the liquid supply means 10 exhibits less pronounced variations over a period of time, thus allowing the water flow rate to be accurately monitored with a paddle wheel-based flow meter 2.

Figure 4:
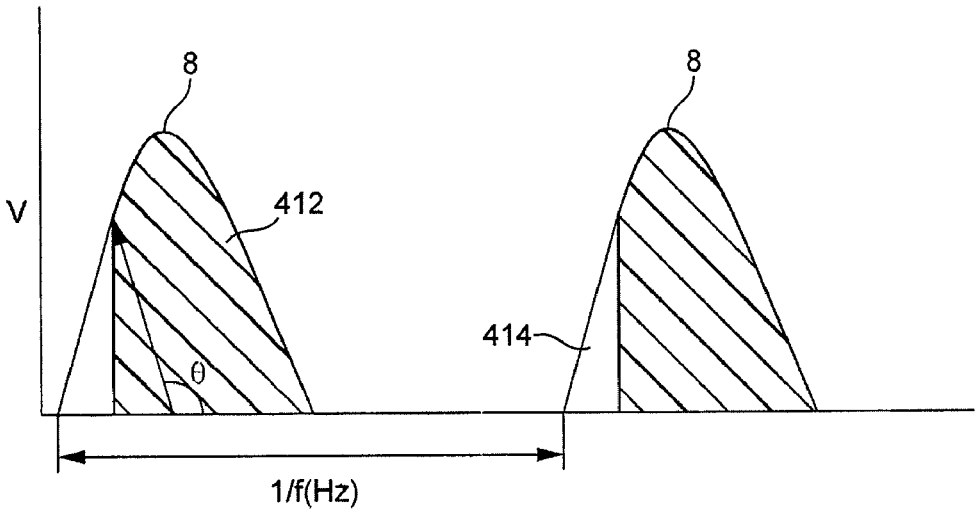

FIG. 4 shows an energizing signal 8 produced by the controller 5. The energizing signal 8 in FIG. 4 is derived from a rectified half period of a current alternating at a frequency f, e.g. 50 Hz or 60 Hz. The amplitude of the energizing signal 8 is the drive voltage V of the solenoid pump 3. The controller 5 is arranged to forward a phase-angled part of this half-phase to the solenoid 220 of the solenoid pump 3. The phase angle θ effectively defines the area 412 under the energizing signal 8. The size of the area 412 is correlated to the amount of energy to be stored in the spring 210. Variation of the phase angle θ thus varies the amount of energy to be stored in the spring 210 of the solenoid pump 3, or, in other words, the location of the intermediate position 235 in the chamber 212. The area 414 indicates the part of the half period of the alternating current that is excluded from the energizing signal 8. The periods of the energizing signal 8 are separated in time by a distance 1/f, i.e. occur in each phase cycle of the alternating current.

The phase angle θ is dynamically adjusted by the controller 5, e.g. in response to the actual flow rate signal 7 from the flow meter 2, indicating a discrepancy between the intended water flow rate and the actual water flow rate, in particular due the obstruction of the conduit by scale deposit.

Figure 5:
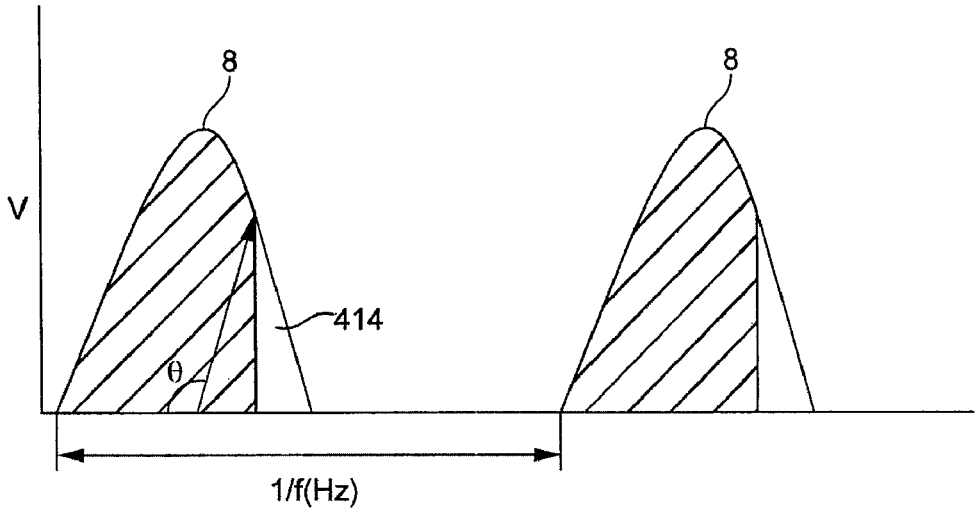

It will be appreciated that the shape of the energizing signal 8 in FIG. 4 is shown by way of non-limiting example only. Other shapes are equally feasible. For instance, as shown in FIG. 5, the area 414 excluded from the energizing signal 8 may be located at the end of the half phase of the alternating current instead of at its beginning. Alternatively, the control signal does not have to be derived from an alternating current, and does not need to have a truncated sinusoidal shape. Other wave forms, e.g. square waves, are equally feasible.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

1 water tank
2 flow meter
3 pump
4 heating means
5 pump controller
6 alert means
7 actual water flow rate signal
8 energizing signal
9 signal processor
10 liquid supply means
11, 204 water outlet
202 water inlet
206 pumping member
208 axis
210 spring
212 chamber
220 solenoid
230 end position
235 intermediate position
240 spring-loaded position It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A process for detecting scale deposits in a liquid supply means of a machine comprising at least a water tank, a pump and a heating means, comprising the step of pumping water from the water tank to the heating means, and energizing the pump by a controller by providing the pump with an energizing signal to produce an intended water flow rate F, measuring an actual water flow rate f and comparing a discrepancy Δ between the actual water flow rate f and the intended water flow rate F to an operating instruction related to scale deposit;

wherein the pump is a solenoid pump comprising a spring-loaded linear pumping member axially displaceable between a spring-loaded position and a spring-released end position controlled by the controller responsive to a current waveform, and arranging to generate an energizing signal for controlling the pumping member from the current waveform by excluding a part of the current waveform from the energizing signal such that the pumping member is energized into an intermediate position between the spring-released end position and the spring-loaded position.

2. A process according to claim 1, comprising energizing the pump by a fixed energy set in view of the intended water flow rate F and the discrepancy Δ between the actual water flow rate f and the intended water flow rate F which is directly compared to a water flow operation instruction related to scale deposit.

3. A process according to claim 1, wherein the controller sets the amount of energy of the pump at least partially in response to an actual water flow rate indication signal and the discrepancy Δ between the actual water flow rate f and the intended flow rate F and/or the energizing signal is compared to an operating instruction related to scale deposit.

4. A process according to claim 1, wherein the energizing signal is a phase-angled sinusoidal signal, with an amount of energy being defined by the phase-angle (θ).

5. A process according to claim 4, wherein the phase-angled sinusoidal signal is a phase-angled part of a rectified half-period of the alternating current.

6. A process according to claim 1, wherein the discrepancy Δ between the actual water flow rate f and the intended water flow rate F is compared to the operating instruction related to scale deposit when the pump reaches a stable operating condition.

7. A process according to claim 1, comprising providing an alert message if a condition selected from the group consisting of: the discrepancy Δ between the actual water flow rate f and the intended water flow rate F is greater than the water flow operating instruction related to scale deposit; and the energizing signal is greater than the pump power operating instruction related to scale deposit, is met.

8. A beverage dispensing apparatus, comprising at least a water tank, a pump, a heating means, a flow meter for measuring an actual flow rate f, a controller setting an amount of energy with which to provide the pump and alert means for comparing at least one parameter selected from the group consisting of a discrepancy Δ between the actual water flow rate and an intended water flow rate F and the energizing signal to a corresponding operating instruction related to scale deposit;

wherein the pump is a solenoid pump comprising a spring-loaded linear pumping member axially displaceable between a spring-loaded position and a spring-released end position controlled by the controller responsive to a current waveform and being arranged to generate an energizing signal for controlling the pumping member from the current waveform by excluding a part of the current waveform from the energizing signal such that the pumping member is energized into an intermediate position between the spring-released end position and the spring-loaded position.

9. An apparatus according to claim 8, comprising a signal processor, wherein the controller is implemented using software on a signal processor.

10. A process for detecting scale deposits in a liquid supply device of a machine comprising a water pump, at least a water tank, and a heater comprising the step of:

pumping water from the water tank to the heater;

energizing the pump using a controller by providing the pump with a signal to provide an intended water flow rate F;

measuring the actual water flow rate f; and comparing a discrepancy Δ between the actual water flow rate f and the intended water flow rate F to an operating instruction related to scale deposit;

the process further, wherein the pump is a solenoid pump, comprising a spring-loaded linear pumping member axially displaceable between a spring-loaded position and a spring-released end position controlled by the controller responsive to a current waveform and arranging to generate an energizing signal for controlling the pumping member from the current waveform by excluding a part of the current waveform from the energizing signal such that the pumping member is energized into an intermediate position between the spring-released end position and the spring-loaded position.

11. A process for detecting scale deposits in a liquid supply means of a machine comprising at least a water tank, a pump and a heating means, comprising the step of pumping water from the water tank to the heating means, and energizing the pump by a controller by providing the pump with an energizing signal to produce an intended water flow rate F, measuring an actual water flow rate f and comparing a discrepancy Δ between the actual water flow rate f and the intended water flow rate F to an operating instruction related to scale deposit;

providing an alert message if a condition selected from the group consisting of: the discrepancy Δ between the actual water flow rate f and the intended water flow rate F is greater than the water flow operating instruction related to scale deposit; and the energizing signal is greater than the pump power operating instruction related to scale deposit, is met.

* * * * *